US009481545B2

(12) United States Patent
Lee et al.

(10) Patent No.: US 9,481,545 B2
(45) Date of Patent: Nov. 1, 2016

(54) FILAMENT FUSING APPARATUS

(71) Applicants: XYZprinting, Inc., New Taipei (TW); Kinpo Electronics, Inc., New Taipei (TW); Cal-Comp Electronics & Communications Company Limited, New Taipei (TW)

(72) Inventors: Yang-Teh Lee, New Taipei (TW); Chuan-Yuan Lee, New Taipei (TW)

(73) Assignees: XYZprinting, Inc., New Taipei (TW); Kinpo Electronics, Inc., New Taipei (TW); Cal-Comp Electronics & Communications Company Limited, New Taipei (TW)

( * ) Notice: Subject to any disclaimer, the term of this patent is extended or adjusted under 35 U.S.C. 154(b) by 166 days.

(21) Appl. No.: 14/604,752

(22) Filed: Jan. 26, 2015

(65) Prior Publication Data

US 2016/0159608 A1 Jun. 9, 2016

(30) Foreign Application Priority Data

Dec. 9, 2014 (CN) ..... 2014 1 0749449

(51) Int. Cl.
*B65H 69/08* (2006.01)

(52) U.S. Cl.
CPC ..... *B65H 69/08* (2013.01)

(58) Field of Classification Search
CPC ..... B65H 69/08
USPC ..... 156/158, 502
See application file for complete search history.

(56) References Cited

U.S. PATENT DOCUMENTS 2,514,184 A * 7/1950 Lower ..... B29C 65/04 156/158
2,514,197 A * 7/1950 Groten ..... B29C 65/04 124/90
3,055,786 A * 9/1962 Hendrix ..... D06B 23/00 156/158
3,070,947 A * 1/1963 De Toledo ..... B65H 69/02 156/158
3,160,547 A * 12/1964 Williams ..... B29C 65/18 156/433
3,615,991 A * 10/1971 Munzner ..... B29C 66/69 156/148
4,255,222 A * 3/1981 Guenther ..... B29C 65/2046 156/433

* cited by examiner

*Primary Examiner* — Jeff Aftergut
(74) *Attorney, Agent, or Firm* — Jianq Chyun IP Office

(57) ABSTRACT

A filament-fusing apparatus includes a first body, a first-heating element, a second body and a second-heating element. The first body includes a first surface and a first-filament groove disposed thereon. The first-heating element disposed on the first surface has a first-connecting groove and a first-overflow groove. Two opposite sides of the first-connecting groove connect the first-filament groove. An axial side of the first-connecting groove connects the first-overflow groove. The second body includes a second surface and a second-filament groove disposed thereon. The second-heating element disposed on the second surface has a second-connecting groove and a second-overflow groove. Two opposite sides of the second-connecting groove connect the second-filament groove. An axial side of the second-connecting groove connects the second-overflow groove. The second body is pivotally connected to the first body to rotate till contacting the first body, such that the second-heating element contacts the first-heating element.

17 Claims, 12 Drawing Sheets

FILAMENT FUSING APPARATUS

CROSS-REFERENCE TO RELATED APPLICATION

This application claims the priority benefit of China application serial no. 201410749449.8, filed on Dec. 9, 2014. The entirety of the above-mentioned patent application is hereby incorporated by reference herein and made a part of this specification.

BACKGROUND

1. Technical Field

The technical field generally relates to a fusing apparatus. More particularly, the technical field relates to filament fusing apparatus.

2. Related Art

Along with advances in computer-aided manufacturing (CAM), the manufacturing industry has developed rapid prototyping (RP) technologies, thereby rapidly fabricating products from an original design concept. Three-dimensional printing is a kind of RP technology and is a technique of constructing a three-dimensional object by stacking construction materials in a fused state one by one based on a digital three-dimensional model. The method is so-called a fused deposition modelling (FDM) method. In the past, the method was often used in fields such as mould manufacturing and industrial design for manufacturing models. Nowadays, it is gradually applied to direct manufacture of some products. In high-value applications (e.g. hip joints or teeth, or some airplane parts) in particular, there have been parts made by printing using such technology, which implies popularization of the "three-dimensional printing" technique.

In a common situation where a current three-dimensional printer is employed, a solid state wire composed of construction materials is heated to render the construction materials in a fused state. The construction materials are then extruded from a print head of the three-dimensional printer. Accordingly, the fused construction materials are stacked layer by layer from bottom to top on a base of the three-dimensional printer, so as to form a three-dimensional object. However, in the three-dimensional printing process, when the wire of construction material is completely consumed, the printing task will be suspended or terminated and replacement with a new wire of construction material will be required for the printing task to resume or start over. Therefore, current three-dimensional printing equipments are still very inconvenient in use.

SUMMARY

Accordingly, the present disclosure is directed to a filament fusing apparatus capable of fusing a filament with another wire to form a new bonded filament.

The present disclosure provides a filament fusing apparatus for bonding two independent filaments. The filament fusing apparatus includes a first body, a second body, a first heat conducting element, a second heat conducting element and a heating unit. The first body has a first surface and a plurality of first filament grooves disposed at the first surface. The first heat conducting element is disposed on the first surface. The first heat conducting element has a first connecting groove and at least one first overflow groove. Two opposite sides of the first connecting groove are connected to the first filament grooves respectively. A side of the first connecting groove is connected to the first overflow groove. The two filaments are adapted to be disposed in the first connecting groove in an overlap manner. The second body has a second surface and a plurality of second filament grooves disposed on the second surface. The second body is pivotally connected to the first body to rotate relative to the first body. The second heat conducting element is disposed on the second surface. The second heat conducting element has a second connecting groove and at least one second overflow groove. Two opposite sides of the second connecting groove is connected to the second filament grooves. A side of the second connecting groove connects the second overflow groove, and the second overflow groove is disposed correspondingly to the first overflow groove. The second body is adapted to rotate till contacting the first body, such that the second heat conducting element contacting the first heat conducting element. The heating unit is disposed on the first body or the second body and contacts the corresponding first heat conducting element or the second heat conducting element to fusing the two filaments into one bonded filament.

Based on the above-mentioned description, the filament fusing apparatus of the present disclosure includes the first body and the second body pivotally connected to each other, such that the second body is adapted to rotate relatively to the first body. The first body and the second body have corresponding filament grooves. The first heat conducting element and the second heat conducting element are disposed on the first body and the second body respectively and each has a connecting groove and an overflow groove. Two opposite ends of the connecting groove are connected to the filament grooves respectively, and the overflow groove is connected to the connecting groove. As such, a user may dispose two filaments in the connecting groove of the first body in an overlap manner, and rotate the second body relatively to the first body to a closing state, so as to fuse an overlap region of the two filaments, so the two filaments are fused into a new bonded filament.

In addition, the two filaments are parallel to each other and disposed in the connecting groove in an overlap manner, so the bonding area between the two filaments is increased, such that the bonding strength of the bonded filament is improved. Moreover, since the two filaments are fused in the overlap manner, surplus melt of the filaments would overflow after the two filaments are fused into the bonded filament. Accordingly, the surplus melt of the filaments can flow to the overflow groove and be cured to form an overflow portion of the bonded filament. The overflow portion of the bonded filament can be stripped off easily. Therefore, in the preset disclosure, the bonded filament bonded by the filament fusing apparatus not only can have better bonding strength, but also can have a smooth outer appearance.

To make the above features and advantages of the invention more comprehensible, embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
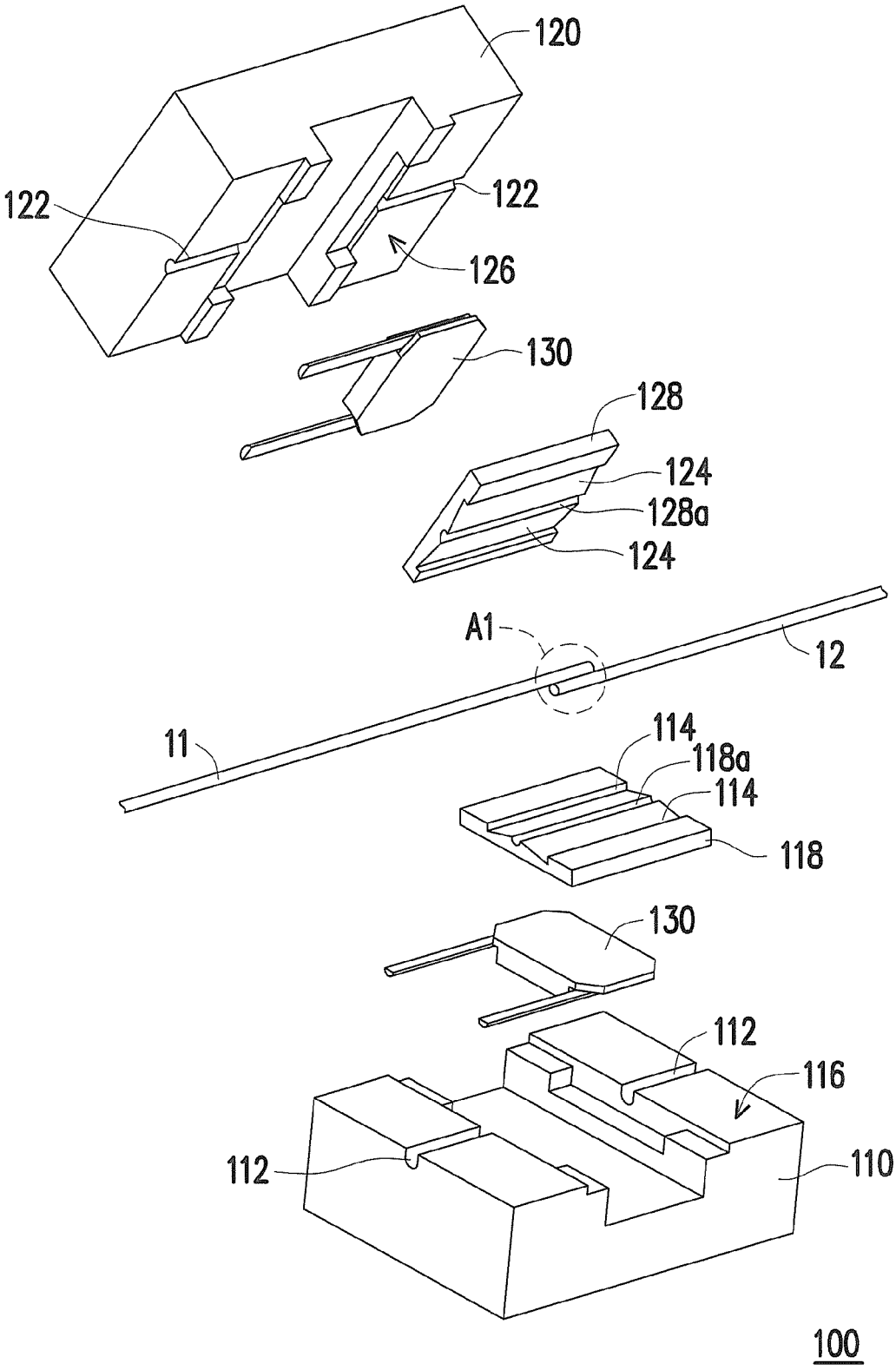
FIG. 1 is an exploded view of a filament fusing apparatus according to an exemplary embodiment.

It is to be understood that both the foregoing and other detailed descriptions, features, and advantages are intended to be described more comprehensively by providing embodiments accompanied with drawings hereinafter. In the following embodiments, wordings used to indicate directions, such as "up," "down," "front," "back," "left," and "right", merely refer to directions in the accompanying drawings. Therefore, the directional wording is used to illustrate rather than limit the invention. Moreover, in the following embodiments, identical reference numerals indicate identical or similar elements.

Figure 2:
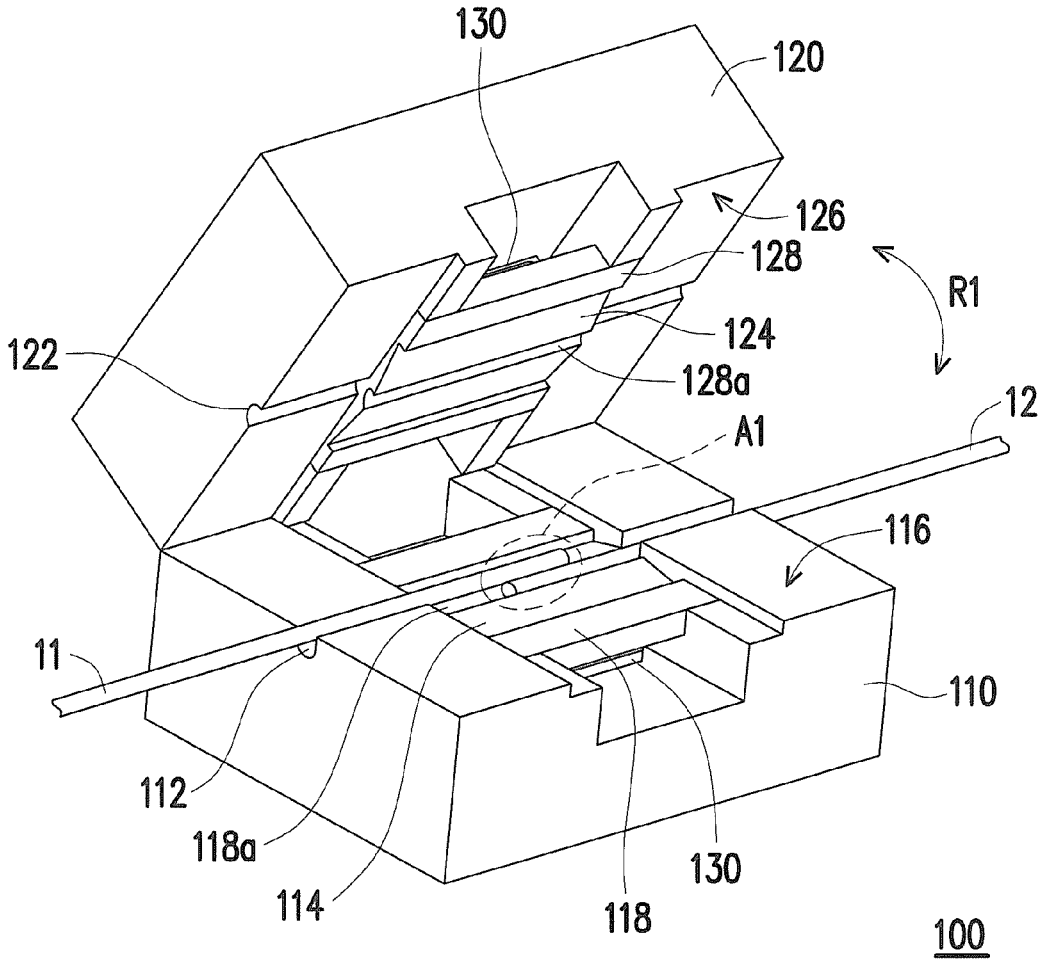
FIG. 2 is a schematic view of the filament fusing apparatus in FIG. 1.

FIG. 1 is an exploded view of a filament fusing apparatus according to an exemplary embodiment. FIG. 2 is a schematic view of the filament fusing apparatus in FIG. 1. Referring to both FIG. 1 and FIG. 2, in the present embodiment, the filament fusing apparatus 100 is configured for bonding two independent filaments 11, 12, so as to fuse the two independent filaments 11, 12 into a new bonded filament. To be specific, the filament fusing apparatus 100 of the present embodiment may be configured to bond two printing filaments for a three-dimensional (3-D) printing apparatus, so as to bond a printing filament in use and another new printing filament to form a new bonded filament. In the present embodiment, the filament fusing apparatus 100 includes a first body 110, a first heat conducting element 118, a second body 120 and a second heat conducting element 128. The first body 110 includes a first surface 116 and a plurality of first filament grooves 112 disposed on the first surface 116. The first heat conducting element 118 is disposed on the first surface 116 and has a first connecting groove 118*a* and a first overflow groove 114. Two opposite ends of the first connecting groove 118*a* are connected to the first filament grooves 112 respectively, and a side of the first connecting groove 118*a* is connected to the first overflow groove 114. The two filaments 11, 12 is adapted to be disposed in the first connecting groove 118*a* in an overlap manner as shown in FIG. 2, and the first heat conducting element 118 contacts an overlap region A1 of the two filaments 11, 12 which are overlapped with each other.

Similarly, the second body 120 includes a second surface 126 and a plurality of second filament grooves 122 disposed on the second surface 126. The second heat conducting element 128 is disposed on the second surface 126 corresponding to the first heat conducting element 118, and has a second connecting groove 128*a* and a second overflow groove 124. Two opposite ends of the second connecting groove 118*a* are connected to the second filament grooves 122 respectively, and a side of the second connecting groove 128*a* is connected to the second overflow groove 124. The second overflow groove 124 is disposed correspondingly to the first overflow groove 114. The second body 120 is pivotally connected to the first body 110 to rotate relatively to the first body 110 along a rotating direction R1.

Figure 3:
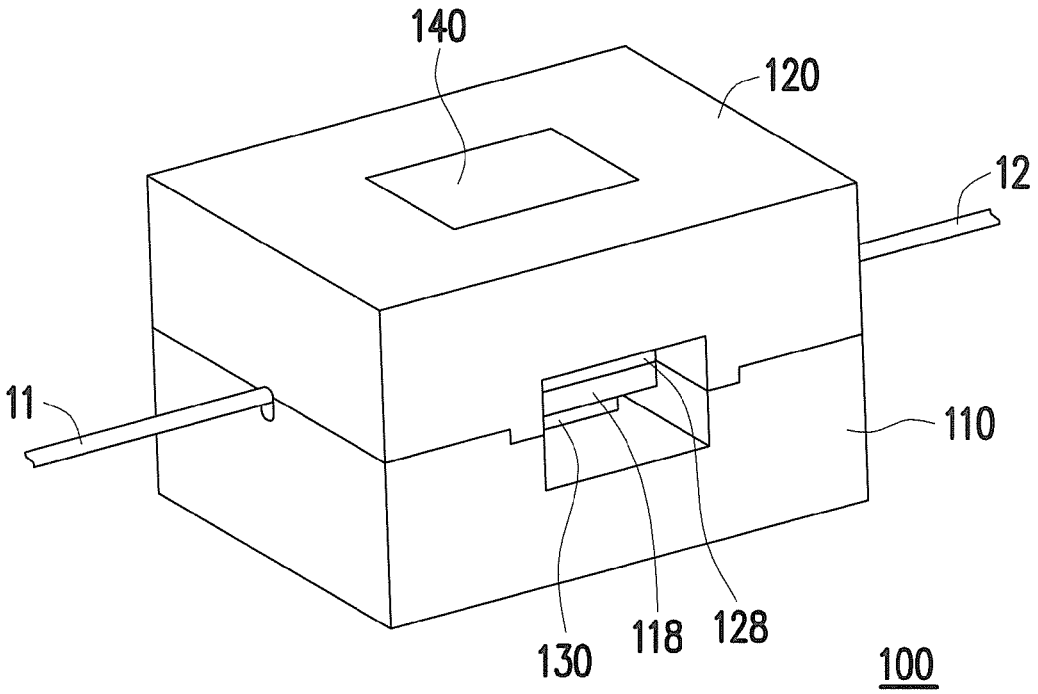
FIG. 3 is a schematic view of the filament fusing apparatus in FIG. 2 performing fusing process to two filaments.
Figure 4:
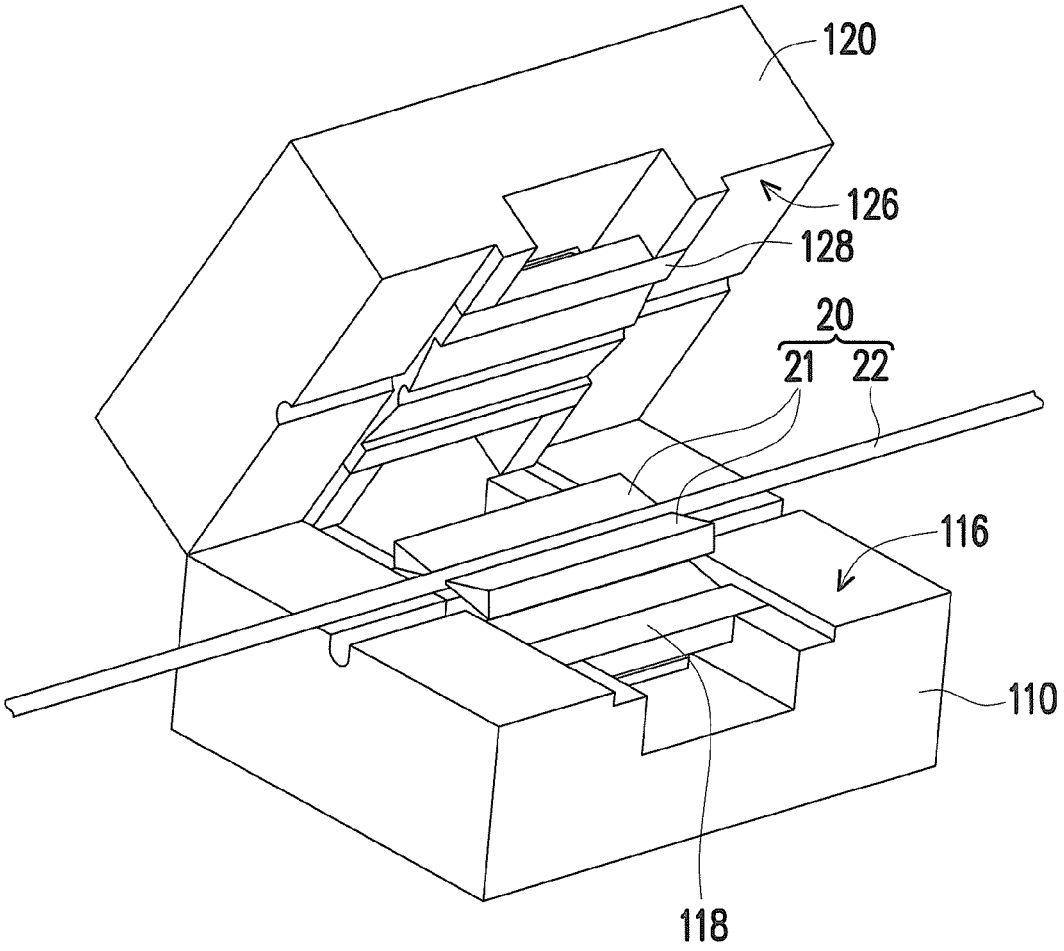
FIG. 4 is a schematic view of the filament fusing apparatus in FIG. 2 fusing the two filaments into a bonded filament.

FIG. 3 is a schematic view of the filament fusing apparatus in FIG. 2 performing fusing process to two filaments. FIG. 4 is a schematic view of the filament fusing apparatus in FIG. 2 fusing the two filaments into a bonded filament. Referring to both FIG. 3 and FIG. 4, the second body 120 is adapted to rotate till contacting the first body 110, such that the second heat conducting element 128 contacts the first heat conducting element 118 and the overlap region A1. Namely, when the second body 120 rotates relatively to the first body 110 to a state shown in FIG. 3, so the second surface 126 contacts the first surface 116, the second heat conducting element 128 contacts the first heat conducting element 118 and the overlap region A1 for fusing the overlap region A1, so as to bond the two filaments 11, 12 to form a new bonded filament 20 as shown in FIG. 4.

In detail, the material of the first heat conducting element 118 and the second heat conducting element 127 may be heat conducting material with high thermal conductivity such as metal. In the present embodiment, the filament fusing apparatus 100 may further include at least one heating unit 130 and a heating control interface 140, wherein the heating unit 130 may disposed on the first body 110 and the second body 120 respectively to heat the corresponding first heat conducting element 118 and the second heat conducting element 128. Of course, the embodiment described above are merely for illustration, in other embodiment, the heating unit 130 may merely be disposed on the first body 110 or the second body 120 to heat the corresponding first heat conducting element 118 or the second heat conducting element 128, and the heat would be transfer to another heat conducting element 118/128 through the characteristic of high thermal conductivity thereof and through the contact of the first heat conducting element 118 and the second heat conducting element 128 when the first body 110 and the second body 120 are in the closing state shown in FIG. 3. In addition, the heating control interface 140 shown in FIG. 3 may be coupled to the heating unit to control the heating unit 130 to perform heating switch and temperature adjustment.

Figure 5:
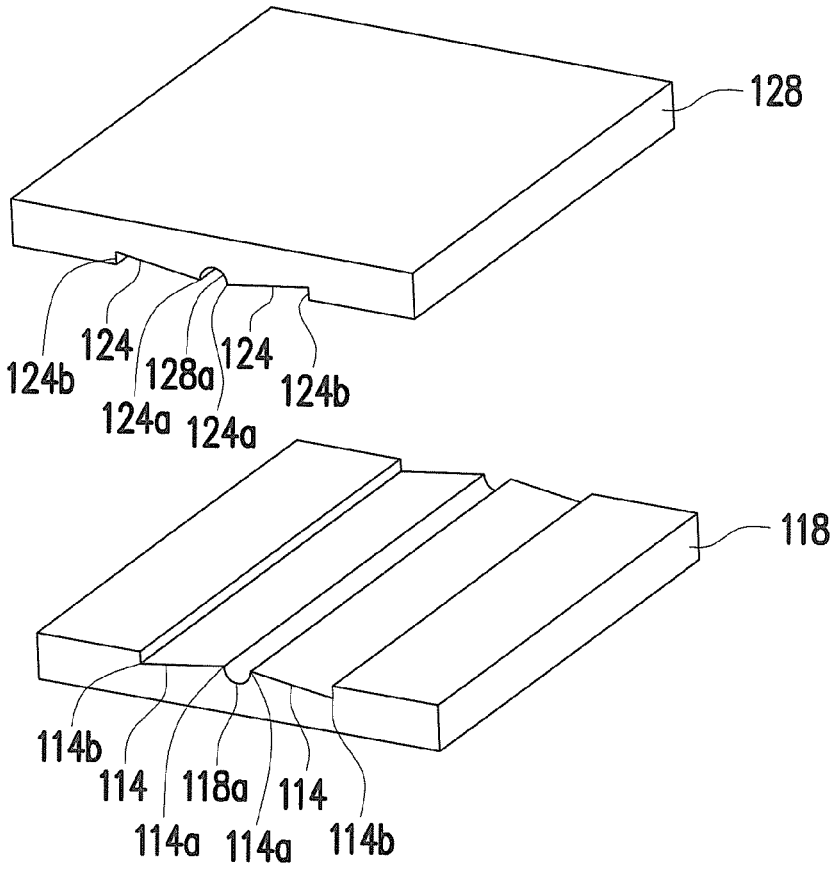
FIG. 5 is a schematic view of a first heat conducting element and a second heat conducting element according to an exemplary embodiment.
Figure 6:
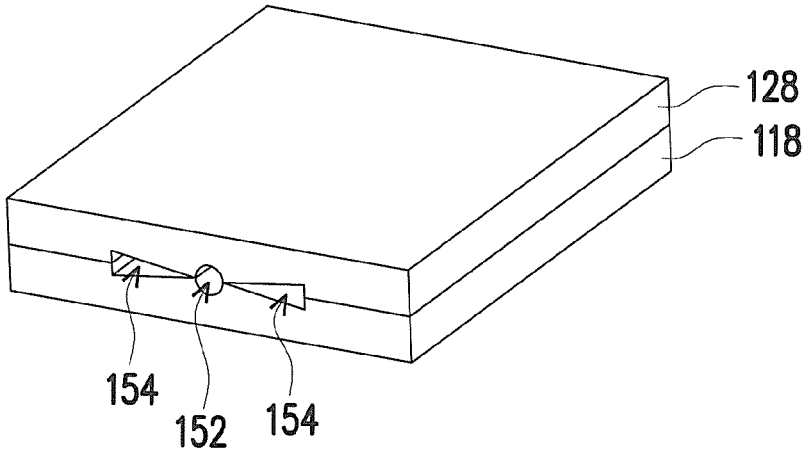
FIG. 6 is a schematic view of the first heat conducting element and the second heat conducting element in FIG. 5 contacting each other.
Figure 7:
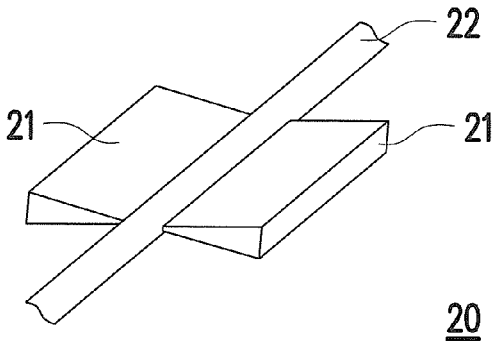
FIG. 7 is a schematic view of a bonded filament according to an exemplary embodiment.

FIG. 5 is a schematic view of a first heat conducting element and a second heat conducting element according to an exemplary embodiment. FIG. 6 is a schematic view of the first heat conducting element and the second heat conducting element in FIG. 5 contacting each other. FIG. 7 is a schematic view of a bonded filament according to an exemplary embodiment. Referring to FIG. 5 and FIG. 6 first, in the present embodiment, the numbers of the first overflow groove 114 and the second overflow groove 124 are both plural (two are illustrated). The first overflow groove 114 may be connected to two opposite sides of the first connecting groove 118 and the second overflow groove 124 may be connected to two opposite sides of the second connecting groove 122 as shown in FIG. 5.

When the second body 120 rotates till contacting the first body 110 as shown in FIG. 3, the first connecting groove 118*a* and the first overflow groove 114 are connected to the second connecting groove 128*a* and the second overflow groove 124 to jointly define a filament containing channel 152 and a melt overflow channel 154 communicating with each other as shown in FIG. 6. The filament containing channel 152 may be configured to contain and shape the bonded filament 20. In the present embodiment, the two filaments 11, 12 are parallel to each other and disposed in the first connecting groove 118*a* in a partially contacting manner to perform fusing process, so the bonding area between the two filaments 11, 12 is increased, such that the bonding strength of the bonded filament 20 is improved and the bonded filament 20 would not break at the bonding point easily. Moreover, the two filaments 11, 12 are fused in the overlap manner, surplus melt of the filaments 11, 12 would overflow after the two filaments 11, 12 are fused to the bonded filament 20, so the surplus melt of the filaments 11, 12 can flow to the melt overflow channel 154 and be cured to form an overflow portion of the bonded filament. As such, the bonded filament 20 bonded by the filament fusing apparatus 100 of the present embodiment has a filament body 22 corresponding to the filament containing channel 152 and a overflow portion 21 corresponding to melt overflow channel 154, and the overflow portion 21 of the bonded filament 20 can be stripped off easily. Therefore, in the preset disclosure, the bonded filament 20 form by the filament fusing apparatus 100 not only can have better bonding strength, but also can have a smooth outer appearance.

For example, the first overflow groove 114 may include a first end 114*a* and a second end 114*b* opposite to the first end 114*a* as shown in FIG. 6. The first end 114*a* is connected to the first overflow groove 118*a*. Similarly, the second overflow groove 124 includes a third end 124*a* and a fourth end 124*b* opposite to the third end 124*a*, and the third end 124*a* is connected to the second overflow groove 128*a*. In the present embodiment, a groove depth of the first end 114*a* is substantially smaller than a groove depth of the second end 114*b* as shown in FIG. 6, and a groove depth of the third end 124*a* is substantially smaller than a groove depth of the fourth end 124*b*. To be specific, a groove depth of the first overflow groove 114 increases gradually from the first end 114*a* to the second end 114*b*. As such, the thickness of the part of the overflow portion 21 connected to the filament body 22 is thinner, and increases gradually toward the end away from the filament body 22 as shown in FIG. 7, such that the overflow portion 21 can be easily stripped off from the filament body 22. Of course, the embodiment shown in FIG. 5 and FIG. 6 is merely for illustration and does not limit the form of the first overflow groove 114 and the second overflow groove 124.

Figure 8:
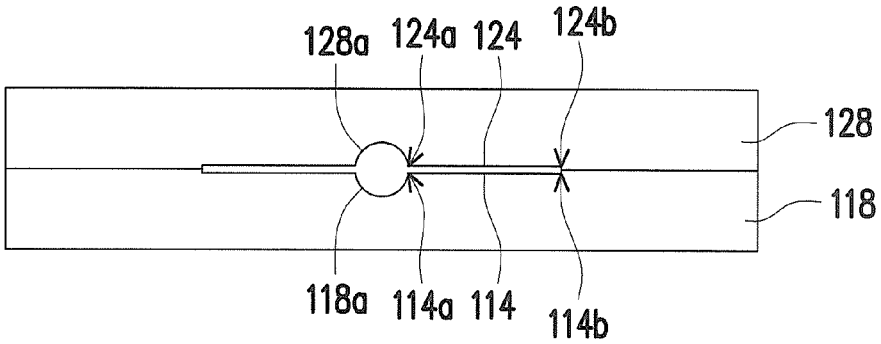
FIG. 8 is a schematic view of a first heat conducting element and a second heat conducting element contacting each other according to an exemplary embodiment.
Figure 9:
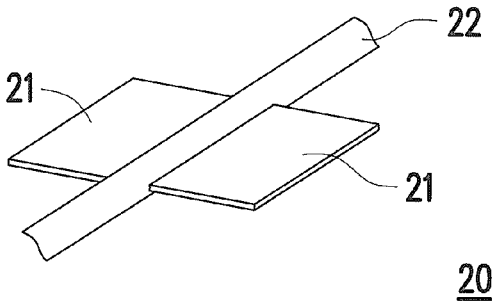
FIG. 9 is a schematic view of a bonded filament according to an exemplary embodiment.

FIG. 8 is a schematic view of a first heat conducting element and a second heat conducting element contacting each other according to an exemplary embodiment. FIG. 9 is a schematic view of a bonded filament according to an exemplary embodiment. It should be noted that the first heat conducting element 118 and the second heat conducting element 128 of the present embodiment are similar to the first heat conducting element 118 and the second heat conducting element 128 shown in FIG. 5 and FIG. 6, and therefore the present embodiment uses the reference numerals of the above embodiments and a portion of the contents thereof, wherein the same reference numerals are used to represent the same or similar components and the same technical content is omitted. The omitted portions are as described in the above embodiments and are not repeated in the present embodiment. The differences between the first heat conducting element 118 and the second heat conducting element 128 of the present embodiment and the first heat conducting element 118 and the second heat conducting element 128 shown in FIG. 5 and FIG. 6 are described hereafter.

Referring to both FIG. 8 and FIG. 9, similar to the previous embodiment, the first overflow groove 114 of the present embodiment also includes a first end 114*a* and a second end 114*b* opposite to the first end 114*a*, and the second overflow groove 124 also includes a third end 124*a* and a fourth end 124*b* opposite to the third end 124*a*, wherein the first end 114*a* is connected to the first overflow groove 118*a*, and the third end 124*a* is connected to the second overflow groove 128*a*. However, in the present embodiment, a groove depth of the first end 114*a* is substantially equal to a groove depth of the second end 114*b*, and a groove depth of the third end 124*a* is substantially equal to a groove depth of the fourth end 124*b*. To be specific, a groove depth of the first overflow groove 114 is substantially the same from the first end 114*a* to the second end 114*b*, and a groove depth of the second overflow groove 124 is substantially the same from the third end 124*a* to the fourth end 124*b*. As such, the thickness of the whole overflow portion 21 of the bonded filament 20 is the same as shown in FIG. 9. Of course, the embodiment shown in FIG. 5 and FIG. 6 is merely for illustration and does not limit the form of the first overflow groove 114 and the second overflow groove 124.

Figure 10:
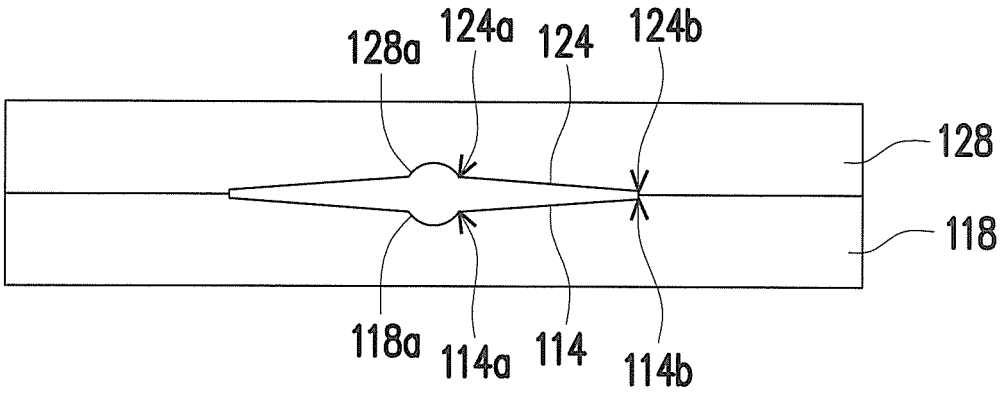
FIG. 10 is a schematic view of a first heat conducting element and a second heat conducting element contacting each other according to an exemplary embodiment.
Figure 11:
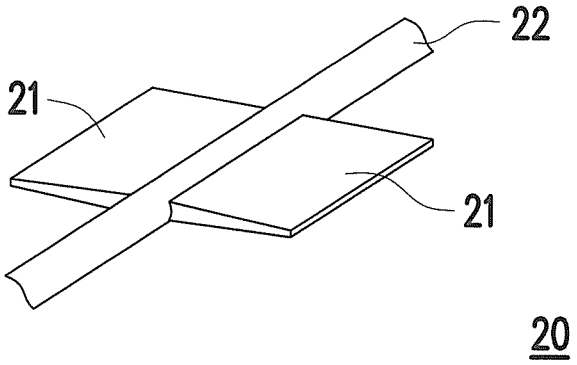
FIG. 11 is a schematic view of a bonded filament according to an exemplary embodiment.

FIG. 10 is a schematic view of a first heat conducting element and a second heat conducting element contacting each other according to an exemplary embodiment. FIG. 11 is a schematic view of a bonded filament according to an exemplary embodiment. It should be noted that the first heat conducting element 118 and the second heat conducting element 128 of the present embodiment are similar to the first heat conducting element 118 and the second heat conducting element 128 shown in FIG. 5 and FIG. 6, and therefore the present embodiment uses the reference numerals of the above embodiments and a portion of the contents thereof, wherein the same reference numerals are used to represent the same or similar components and the same technical content is omitted. The omitted portions are as described in the above embodiments and are not repeated in the present embodiment. The differences between the first heat conducting element 118 and the second heat conducting element 128 of the present embodiment and the first heat conducting element 118 and the second heat conducting element 128 shown in FIG. 5 and FIG. 6 are described hereafter.

Referring to both FIG. 10 and FIG. 11, similar to the previous embodiment, the first overflow groove 114 similar to the previous embodiment, the first overflow groove 114 of the present embodiment also includes a first end 114*a* and a second end 114*b* opposite to the first end 114*a*, and the second overflow groove 124 also includes a third end 124*a* and a fourth end 124*b* opposite to the third end 124*a*, wherein the first end 114*a* is connected to the first overflow groove 118*a*, and the third end 124*a* is connected to the second overflow groove 128*a*. However, in the present embodiment, a groove depth of the first end 114*a* is substantially greater than a groove depth of the second end 114*b*, and a groove depth of the third end 124*a* is substantially greater than a groove depth of the fourth end 124*b*. To be specific, a groove depth of the first overflow groove 114 decreases gradually from the first end 114*a* to the second end 114*b*, and a groove depth of the second overflow groove 124 decreases gradually from the third end 124*a* to the fourth end 124*b*. As such, the thickness of the part of the overflow portion 21 connected to the filament body 22 is thicker, and decreases gradually toward the end away from the filament body 22 as shown in FIG. 11, such that the surplus melt of the filaments can flow from the connecting grooves 118*a*, 128*a* to the overflow grooves 114, 124 smoothly, and fill the overflow grooves 114, 124 easily and quickly.

Figure 12:
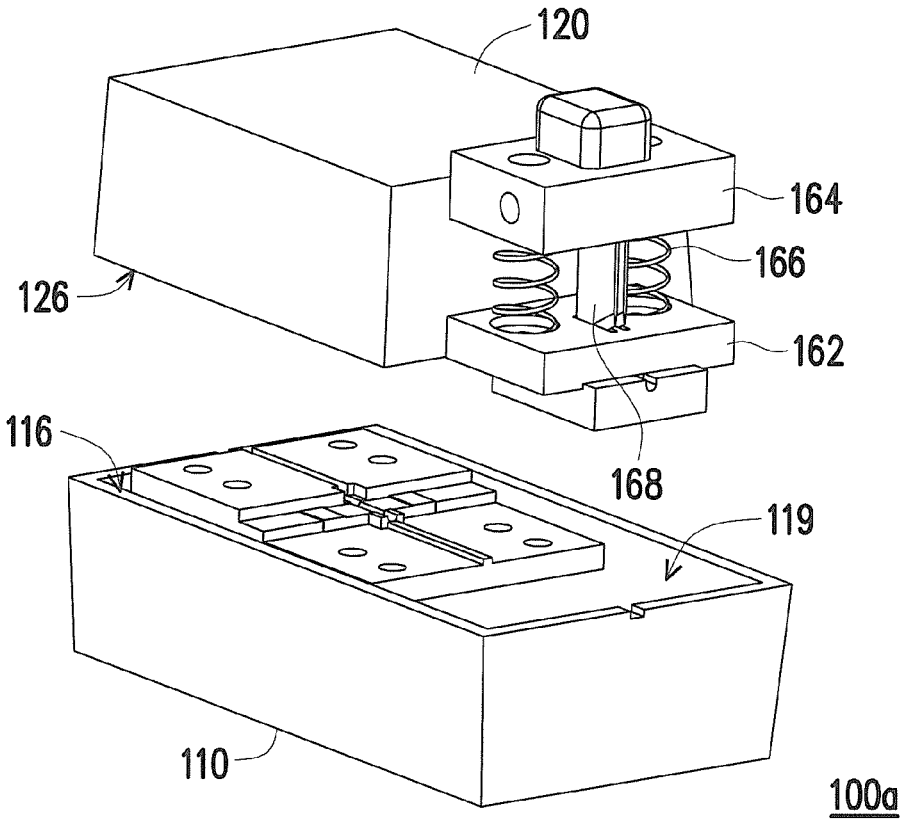
FIG. 12 is a partial exploded view of a filament fusing apparatus according to an exemplary embodiment.
Figure 13:
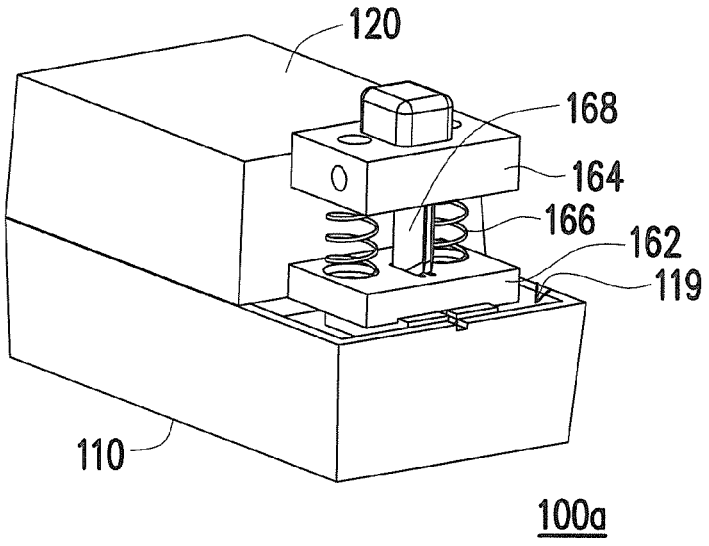
FIG. 13 is a schematic view of the filament fusing apparatus according to an exemplary embodiment.

FIG. 12 is a partial exploded view of a filament fusing apparatus according to an exemplary embodiment. FIG. 13 is a schematic view of the filament fusing apparatus according to an exemplary embodiment. It should be noted that the filament fusing apparatus 100*a* of the present embodiment are similar to the filament fusing apparatus 100 described above, and therefore the present embodiment uses the reference numerals of the above embodiments and a portion of the contents thereof, wherein the same reference numerals are used to represent the same or similar components and the same technical content is omitted. The omitted portions are as described in the above embodiments and are not repeated in the present embodiment. The differences between the filament fusing apparatus 100*a* of the present embodiment and the above-mentioned filament fusing apparatus 100 are described hereafter.

Referring to both FIG. 12 and FIG. 13, the filament fusing apparatus 100*a* of the present embodiment further includes a trimming mechanism 160, and the first body 110 further includes a carrying portion 119 protruded from the second body 120. Namely, when the second body rotates till contacting the first body 110, the second body 120 exposes the carrying portion 119. The trimming mechanism 160 is disposed on the carrying portion 119 to trim the overflow portion 21 of the bonded filament 20 shown in FIG. 7, FIG. 9 and FIG. 11, such that the overflow portion 21 of the bonded filament 20 is separated from the filament body 22.

In detail, the trimming mechanism 160 may include a carrying platform 162, a trimming platform 164, an elastic connecting element 166 and a trimming element 168 as shown in FIG. 12. The carrying platform 162 is disposed at carrying portion 119 of the first body 110. The bonded filament 20 is adapted to be disposed on the carrying platform 162. The trimming platform 164 is connected to the carrying platform 162, and configured for moving relatively to the carrying platform 162 to move toward or away from the carrying platform 162. To be specific, the elastic connecting element 166 is connected between the carrying platform 162 and the trimming platform 164, such that the trimming platform 164 is adapted to move along an axial direction of the elastic connecting element 166 to move toward or away from the carrying platform 162. The trimming element 162 is disposed on the trimming platform 164, so as to trim the overflow portion 21 of the bonded filament 20 when the trimming platform 164 moves toward the carrying platform 162.

In the present embodiment, the elastic connecting element 160 further includes an elastic restoring element 166 leaning between the carrying platform 162 and the trimming platform 164. When the trimming platform 164 moves toward the carrying platform 162, the elastic restoring element 166 is compressed to generate an elastic restoring force. After the trimming element 162 trims the overflow portion 21 of the bonded filament 20, the elastic restoring element 166 utilizes its own elastic restoring force to push the trimming platform 164 back to an initial position. As such, after the user uses the filament fusing apparatus 100*a* to fuse the filaments 11, 12 shown in FIG. 1 into the bonded filament 20, the user may place the bonded filament 20 on the carrying platform 162, and makes the overflow portion 21 of the bonded filament 20 corresponding to the position of the trimming element 168, then moves the trimming platform 164 toward the carrying platform 162 to trim the overflow portion 21 of the bonded filament 20 through the trimming element 168 for separating the overflow portion 21 and the filament body 22, such that the filament body 22 can have a smooth outer surface after bonding.

Figure 14:
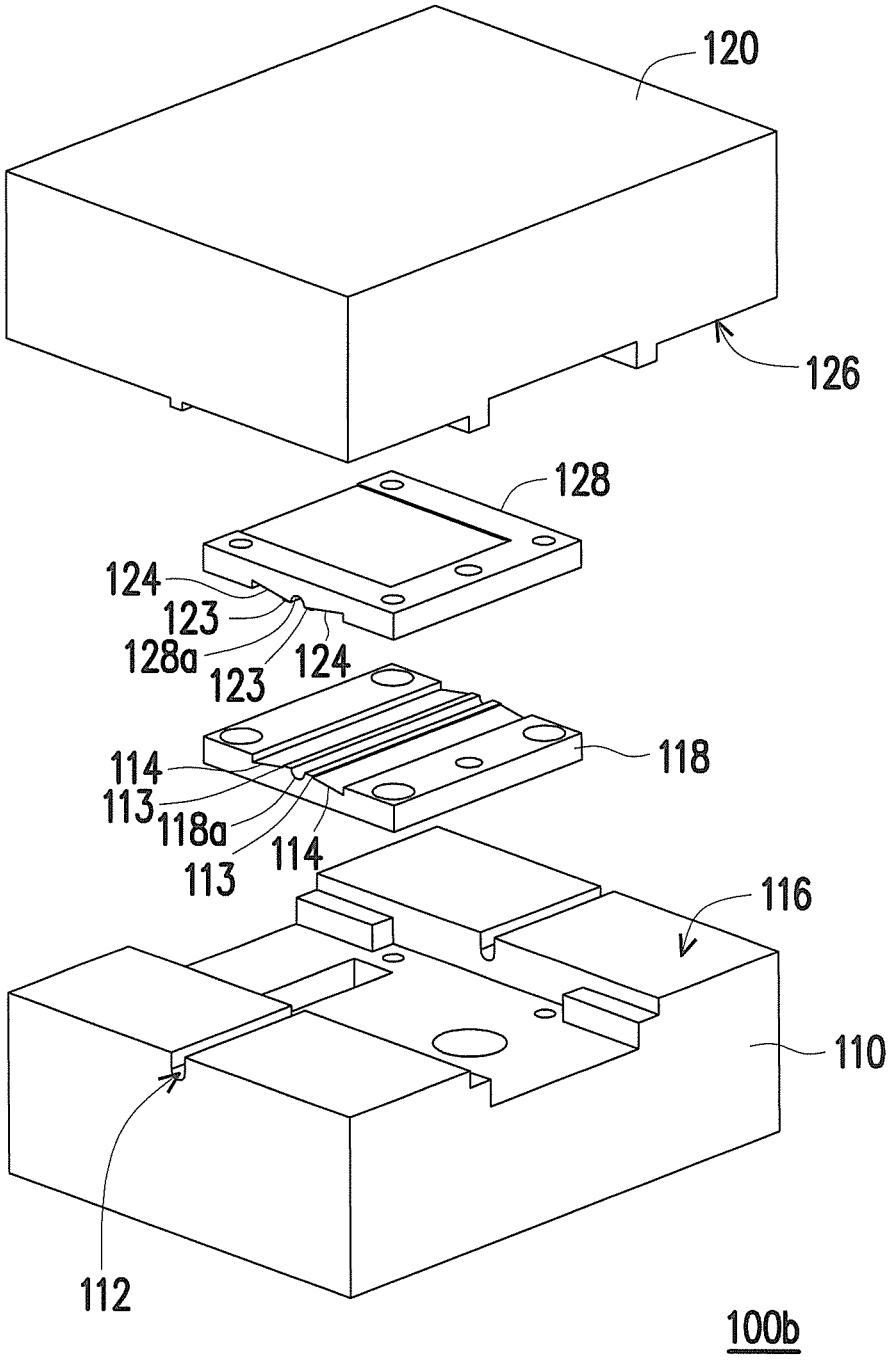
FIG. 14 is an exploded view of a filament fusing apparatus according to an exemplary embodiment.
Figure 15:
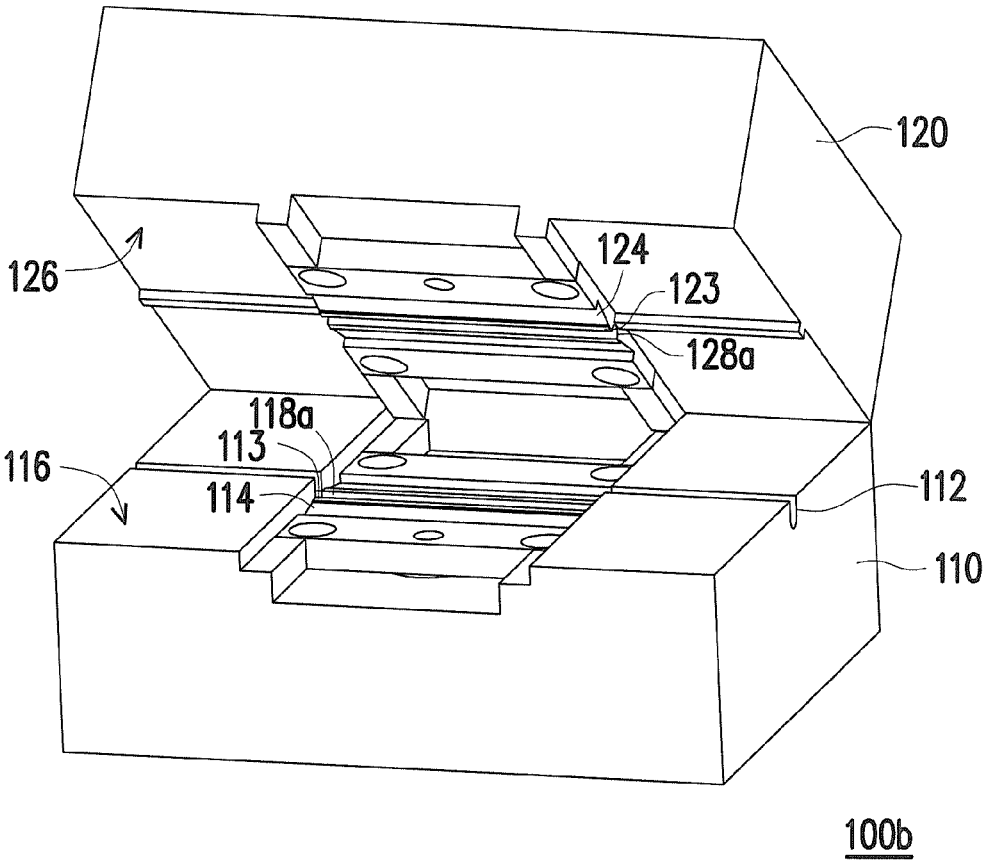
FIG. 15 is a schematic view of the filament fusing apparatus in FIG. 14.

FIG. 14 is an exploded view of a filament fusing apparatus according to an exemplary embodiment. FIG. 15 is a schematic view of the filament fusing apparatus in FIG. 14. It should be noted that the filament fusing apparatus 100*b* of the present embodiment are similar to the filament fusing apparatus 100 described above, and therefore the present embodiment uses the reference numerals of the above embodiments and a portion of the contents thereof, wherein the same reference numerals are used to represent the same or similar components and the same technical content is omitted. The omitted portions are as described in the above embodiments and are not repeated in the present embodiment. The differences between the filament fusing apparatus 100*b* of the present embodiment and the above-mentioned filament fusing apparatus 100 are described hereafter.

Referring to FIG. 14 and FIG. 15, in the present embodiment, the first heat conducting element 118 of the first body 110 may further include a first cutting surface 113, and the second heat conducting element 128 of the second body 120 may further include a second cutting surface 123, wherein the first cutting surface 113 is disposed on the first surface 116 and connected between the first connecting groove 118*a* and the first overflow groove 114. The second cutting surface 123 is disposed on the second surface 126 and connected between the second connecting groove 128*a* and the second overflow groove 124. The first cutting surface 113 contacts the second cutting surface 126 when the second body 120 rotates till contacting the first body 110.

Figure 16:
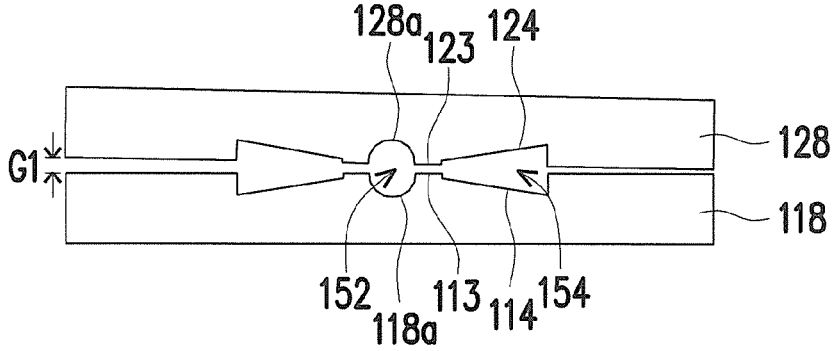
FIG. 16 and FIG. 17 are schematic views of a first cutting surface and a second cutting surface in FIG. 14 maintaining a gap therebetween.
Figure 17:
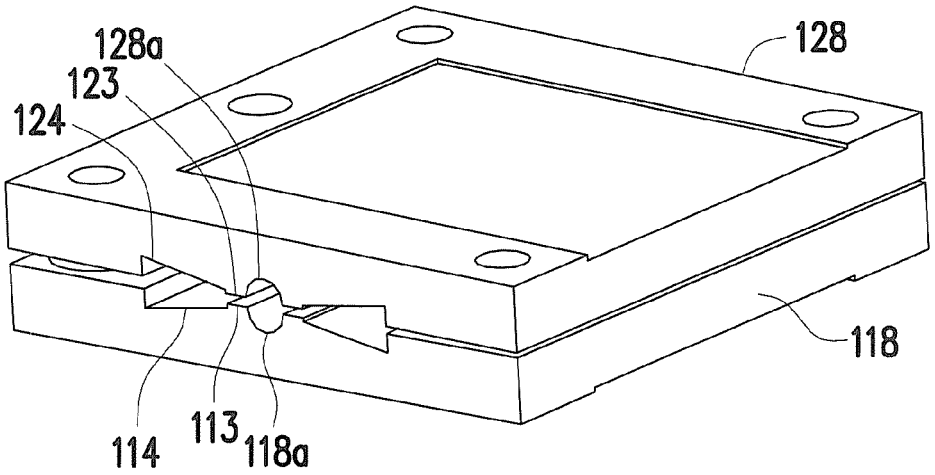
Figure 18:
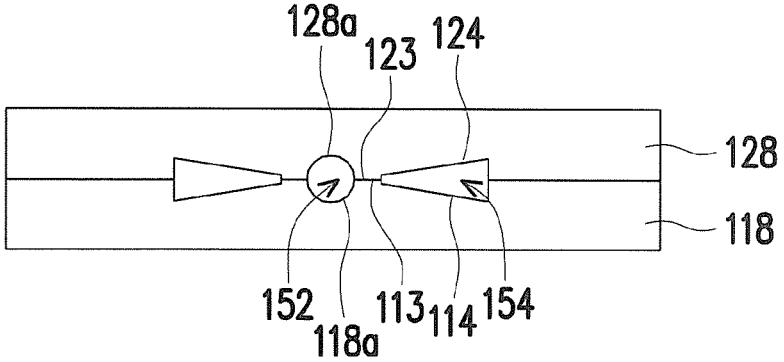
FIG. 18 and FIG. 19 are schematic views of the first cutting surface and the second cutting surface in FIG. 14 contacting each other.
Figure 19:
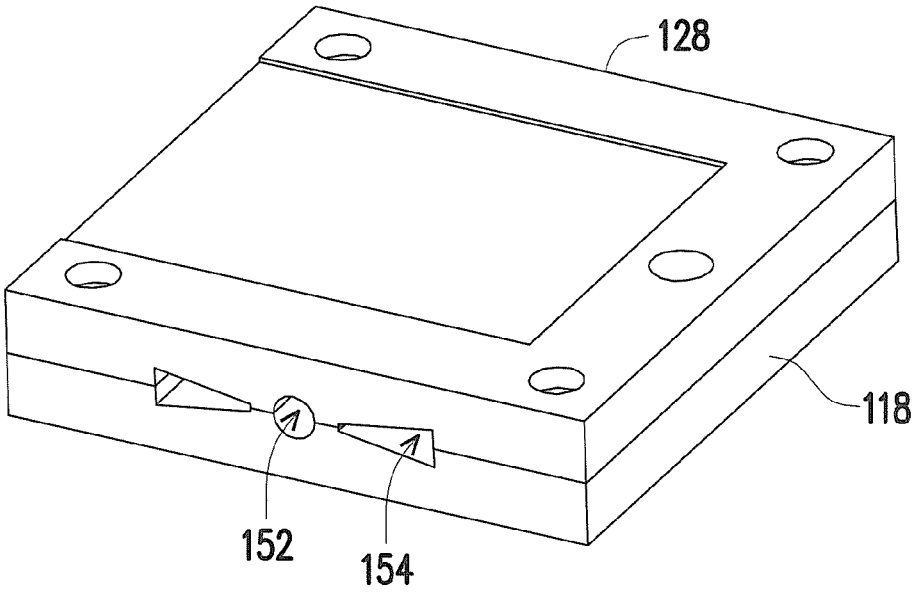

FIG. 16 and FIG. 17 are schematic views of a first cutting surface and a second cutting surface in FIG. 14 maintaining a gap therebetween. FIG. 18 and FIG. 19 are schematic views of the first cutting surface and the second cutting surface in FIG. 14 contacting each other. It should be noted that, for clearness and simplicity of the figures, FIG. 16 to FIG. 19 merely show the first heat conducting element 118 and second heat conducting element 128 of the filament fusing apparatus 100*b* for illustration. Referring to FIG. 18 and FIG. 19 first, when the second body rotates till contacting the first body 110, the first connecting groove 118*a* and the second connecting groove 128*a* are connected to each other to jointly define a filament containing channel 152 and the at least one first overflow groove 114 and the at least one second overflow groove 124 are connected to each other to jointly define at least one melt overflow channel 154. The first cutting surface 113 and the second cutting surface 126 are located between the filament containing channel 152 and the corresponding melt overflow channel 154 and contact with each other to stop the filament containing channel 152 and the corresponding melt overflow channel 154 from communicating with each other.

As such, when the two filaments 11, 12 are disposed in the first connecting groove 118*a* in an overlap manner as shown in FIG. 1, an overlap region A1 of the two filaments 11, 12 protruded from the first surface 116 due to the overlap of the two filaments 11, 12. Therefore, when the second body 120 rotates toward the first body 110, the overlap region A1 leans between the first body 110 and the second body 120 to maintain a gap G1 between the first cutting surface 113 and the second cutting surface 123 as shown in FIG. 16, such that the filament containing channel 152 and the corresponding melt overflow channel 154 communicate with each other through the gap G1. As such, when the first heat conducting element 118 and the second heat conducting element 128 heat up the overlap region A1 of the two filaments 11, 12 to fuse the overlap region A1, surplus melt of filaments 11, 12 may flow to the melt overflow channel 154 through the gap G1. After the surplus melt of filaments 11, 12 flows to the melt overflow channel 154, the first body 110 and the second body 120 are closed completely and contact with each other as shown in FIG. 18 and FIG. 19. At the time, the first cutting surface 113 and the second cutting surface 126 contact with each other to block the communication between the filament containing channel 152 and the melt overflow channel 154, such that the melt of the filaments 11, 12 would not flow to the melt overflow channel 154 and the filament containing channel 152 is separated from the melt overflow channel 154. As such, the overflow portion and the filament body of the bonded filament foil red by the filament fusing apparatus 100*b* of the present embodiment are separated from each other after moulding and curing, so the bonded filament can have a smooth outer appearance.

In sum, the filament fusing apparatus of the present disclosure includes the first body and the second body pivotally connected to each other, such that the second body is adapted to rotate relatively to the first body. The first body and the second body have corresponding filament grooves. The first heat conducting element and the second heat conducting element are disposed on the first body and the second body respectively and each includes a connecting groove and an overflow groove. Two opposite ends of the connecting groove are connected to the filament grooves respectively, and the overflow groove is connected to the connecting groove. As such, a user may dispose two filaments in the connecting groove of the first body in an overlap manner, and rotate the second body relatively to the first body to a closing state, so as to fuse an overlap region of the two filaments, so the two filaments are fused into a new bonded filament.

In addition, the two filaments are parallel to each other and disposed in the connecting groove in an overlap manner, so the bonding area between the two filaments is increased, such that the bonding strength of the bonded filament is improved. Moreover, since the two filaments are fused in the overlap manner, surplus melt of the filaments would overflow after the two filaments are fused into the bonded filament. Accordingly, the surplus melt of the filaments can flow to the overflow groove and be cured to form an overflow portion of the bonded filament. The overflow portion of the bonded filament can be stripped off easily. Moreover, the filament fusing apparatus may further include a trimming mechanism for trimming the overflow portion of the bonded filament. Therefore, in the preset disclosure, the bonded filament formed by the filament fusing apparatus not only can have better bonding strength, but also have a smooth outer appearance.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A filament fusing apparatus, for bonding two independent filaments, the filament fusing apparatus comprising:

a first body having a first surface and a plurality of first filament grooves disposed at the first surface;

a first heat conducting element disposed on the first surface, the first heat conducting element having a first connecting groove and at least one first overflow groove, two opposite sides of the first connecting groove connected to the first filament grooves respectively, the first overflow groove connected to a side of the first connecting groove, and the two filaments adapted to be disposed in the first connecting groove in an overlap manner;

a second body having a second surface and a plurality of second filament grooves disposed on the second surface, the second body pivotally connected to the first body to rotate relative to the first body;

a second heat conducting element disposed on the second surface, the second heat conducting element having a second connecting groove and at least one second overflow groove, two opposite sides of the second connecting groove connected to the second filament grooves, the second overflow groove connected to a side of the second connecting groove, and the second overflow groove disposed correspondingly to the first overflow groove, the second body adapted to rotate till contacting the first body, such that the second heat conducting element contacting the first heat conducting element; and a heating unit disposed on the first body or the second body, and contacting the corresponding first heat conducting element or the second heat conducting element to fusing the two filaments into one bonded filament.

2. The filament fusing apparatus as claimed in claim 1, wherein the numbers of the at least one first overflow groove and the at least one second overflow groove are both plural, the first overflow grooves are connected to two opposite sides of the first connecting groove, and the second overflow grooves are connected to two opposite sides of the second connecting groove.

3. The filament fusing apparatus as claimed in claim 1, wherein the first overflow groove comprises a first end and a second end opposite to the first end, the first end is connected to the first overflow groove, the second overflow groove comprises a third end and a fourth end opposite to the third end, the third end is connected to the second overflow groove.

4. The filament fusing apparatus as claimed in claim 3, wherein a groove depth of the first end is substantially smaller than a groove depth of the second end, and a groove depth of the third end is substantially smaller than a groove depth of the fourth end.

5. The filament fusing apparatus as claimed in claim 3, wherein a groove depth of the first end is substantially equal to a groove depth of the second end, and a groove depth of the third end is substantially equal to a groove depth of the fourth end.

6. The filament fusing apparatus as claimed in claim 3, wherein a groove depth of the first end is substantially greater than a groove depth of the second end, and a groove depth of the third end is substantially greater than a groove depth of the fourth end.

7. The filament fusing apparatus as claimed in claim 1, wherein the two filaments are parallel to each other and disposed in the first connecting groove in a partially contacting manner.

8. The filament fusing apparatus as claimed in claim 1, wherein when the second body rotates till contacting the first body, the first connecting groove and the first overflow groove are connected to the second connecting groove and the second overflow groove respectively to jointly define a filament containing channel and a melt overflow channel.

9. The filament fusing apparatus as claimed in claim 8, wherein the bonded filament comprises a filament body corresponding to the filament containing channel and an overflow portion corresponding to the melt overflow channel.

10. The filament fusing apparatus as claimed in claim 9, further comprising a trimming mechanism, wherein the first body further comprises a carrying portion protruded from the second body, the trimming mechanism is disposed on the carrying portion to trim the overflow portion, such that the overflow portion is separated from the filament body.

11. The filament fusing apparatus as claimed in claim 10, wherein the trimming mechanism comprises a carrying platform, a trimming platform and a trimming element, the carrying platform is disposed at the first body, the bonded filament is adapted to be disposed on the carrying platform, the trimming platform is connected to the carrying platform and configured for moving relatively to the carrying platform to move toward or away from the carrying platform, the trimming element is disposed on the trimming platform so as to trim the overflow portion when the trimming platform move toward the carrying platform.

12. The filament fusing apparatus as claimed in claim 10, wherein the trimming mechanism further comprises an elastic connecting element connected between the carrying platform and the trimming platform, such that the trimming platform is adapted to move along an axial direction of the elastic connecting element to move toward or away from the carrying platform.

13. The filament fusing apparatus as claimed in claim 10, wherein the elastic connecting element further comprises an elastic restoring element leaning between the carrying platform and the trimming platform.

14. The filament fusing apparatus as claimed in claim 8, wherein the first heat conducting element further comprises a first cutting surface disposed on the first surface and connected between the first connecting groove and the first overflow groove, the second heat conducting element further comprises a second cutting surface disposed on the second surface and connected between the second connecting groove and the second overflow groove, the first cutting surface contacts the second cutting surface when the second body rotates till contacting the first body.

15. The filament fusing apparatus as claimed in claim 14, wherein when the second body rotates toward the first body, an overlap region of the two filaments leans between the first body and the second body to maintain a gap between the first cutting surface and the second cutting surface, such that the filament containing channel and the melt overflow channel communicate with each other through the gap.

16. The filament fusing apparatus as claimed in claim 15, wherein the overlap region is fused, such that the second cutting surface contacts the first cutting surface to stop the filament containing channel and the melt overflow channel from communicating with each other.

17. The filament fusing apparatus as claimed in claim 1, further comprising a heating control interface coupled to the heating unit for controlling the heating unit to perform heating switch and temperature adjustment.

* * * * *